US007476788B2

(12) United States Patent
Yoshisue

(10) Patent No.: US 7,476,788 B2
(45) Date of Patent: Jan. 13, 2009

(54) DAMPER LEVER FOR UPRIGHT PIANO

(75) Inventor: Kenji Yoshisue, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 11/479,445

(22) Filed: Jun. 30, 2006

(65) Prior Publication Data

US 2007/0006709 A1 Jan. 11, 2007

(30) Foreign Application Priority Data

Jul. 5, 2005 (JP) ..... 2005-195761

(51) Int. Cl.
*G10C 3/00* (2006.01)

(52) U.S. Cl. ..... 84/216

(58) Field of Classification Search ..... 84/172, 84/236–242

See application file for complete search history.

(56) References Cited

U.S. PATENT DOCUMENTS 6,051,307 A 4/2000 Kido et al.
7,141,728 B2 * 11/2006 Yoshisue et al. ..... 84/236

FOREIGN PATENT DOCUMENTS

JP 2004-318042 11/2004

* cited by examiner

*Primary Examiner*—Kimberly R Lockett
(74) *Attorney, Agent, or Firm*—Crowell & Moring LLP

(57) ABSTRACT

A damper for an upright piano is provided for improving sound stopping capabilities and consequently improving sequential touching capabilities without adversely affecting a key touch feeling. The damper lever for an upright piano is pressed against a vibrating string to stop the vibration in response to a released key, in order to stop sound which has been generated from the vibrating string. The damper lever comprises a molding molded by a continuous fiber method and made of a thermoplastic resin containing long fibers for reinforcement.

11 Claims, 4 Drawing Sheets

| | EMBODIMENT | FIRST COMPARATIVE EXAMPLE | SECOND COMPARATIVE EXAMPLE |
|---|---|---|---|
| WEIGHT RATIO | 1.04 | 1.0 | 0.89 |
| RIGIDITY RATIO | 2.02 | 1.0 | 2.33 |

| | EMBODIMENT | FIRST COMPARATIVE EXAMPLE | SECOND COMPARATIVE EXAMPLE |
|---|---|---|---|
| ATTENUATION TIME RATIO | 0.84 | 1.0 | 0.91 |

DAMPER LEVER FOR UPRIGHT PIANO

BACKGROUND OF THE INVENTION

1. Field of the Invention

The present invention relates to a damper lever for an upright piano, provided as part of a damper, which is pressed against a vibrating string to stop the vibration in response to a released key, in order to stop sound which has been generated from the vibrating string.

2. Description of the Prior Art

Generally, a damper used in an upright piano comprises a damper lever flange, a damper lever pivotably mounted to the damper lever flange and extending in the vertical direction, a damper head attached to an upper end of the damper lever, and a damper lever spring for urging the damper lever backward toward an associated string. The conventional damper lever is made of a synthetic resin such as an ABS resin or a wood material. In a key released state, the damper head is in contact with and pressed against a vertically stretched string by an urging force of the damper lever spring.

As a player touches a key, the damper lever is driven or pressed by a spoon attached to a wippen, and pivotally moves against the urging force of the damper lever spring, causing the damper head to move away from the string. Then, the string is struck from the front in this state for vibration, thereby generating sound. Subsequently, as the key is released, the damper lever performs operations reverse to those associated with a key touch process, causing the damper head to come into contact with the string from the front at a point different from the point struck by the hammer. Then, the damper head is pressed against the string with the urging force of the damper lever spring, causing the string and damper to vibrate together, and the vibrations rapidly attenuate to lose the sound (damping).

As described above, in the upright piano, the damper head is pressed against the string from the front in the same manner as the hammer by the urging force of the damper lever spring to attenuate vibrations of the string, thus stopping the sound. Due to the configuration as described above, the upright piano requires a relatively long time for stopping the sound. For this reason, when the same key is repeatedly touched, for example, the associated string fails to normally vibrate in some cases even if the hammer strikes the string. Specifically, when the same key is repeatedly touched, the string is repeatedly struck in sequence, so that if a long time is taken to attenuate the vibrations of the string and damper, the damper head moves away from the string in response to a key touch before the vibration of the string, generated by the preceding striking, has not been sufficiently attenuated. Therefore, the string is struck the next time while the vibration of the string still remains, possibly resulting in a failure in normally vibrating the string to generate clear play sound. While it is contemplated to increase the spring force of the damper lever spring for improving the repetitive touching capabilities, the increased spring force will adversely affect the key touch feeling.

Laid-open Japanese Patent Application No. 2004-318042, for example, discloses an action for a conventional piano (pages 5-7, FIGS. 1, 2). This action, which basically has the same configuration as ordinary actions, comprises a wippen carried on a key in a key released state, a repetition lever pivotably attached to the wippen, a jack, and the like. The wippen comprises a molding made of an ABS resin containing carbon fibers for reinforcement, and therefore has a very high rigidity. The high rigidity permits the formation of a plurality of recesses on a left and a right side surface of the wippen in order to maximally reduce the weight of the wippen. Consequently, the wippen operates with agility to strike a string at an earlier timing, thus improving the responsibility of the action to a key touch.

The damper is also provided in grand pianos. This damper presses against a horizontally stretched string near a point struck by a hammer from above by its self weight, thereby attenuating vibrations of the string to stop sound. Thus, the grand piano can effectively attenuate the vibrations of the string to promptly stop the sound, so that even when the same key is repeatedly touched, the grand piano is free from the aforementioned drawbacks experienced by the upright piano.

SUMMARY OF THE INVENTION

The present invention has been made to solve the problems as mentioned above inherent to the upright piano, and it is therefore an object of the invention to provide a damper lever for an upright piano which is capable of improving sound stopping capabilities and consequently improving sequential touching capabilities without adversely affecting a key touch feeling.

To achieve the above object, the present invention provides a damper lever for an upright piano, which is adapted to be pressed against a vibrating string to stop the vibration in response to a released key, in order to stop sound which has been generated from the vibrating string. The damper lever is characterized by comprising a molding molded by a continuous fiber method and made of a thermoplastic resin containing long fibers for reinforcement.

According to the damper lever described above, the damper lever comprises a molding molded by a continuous fiber method and made of a thermoplastic resin containing long fibers for reinforcement. Here, the continuous fiber method involves injection molding of a pellet containing fibrous reinforcing materials of the same length covered with a thermoplastic resin to produce moldings. According to the continuous fiber method, relatively long fibrous reinforcing materials having a length of 0.5 mm, for example, are contained in the moldings. Thus, the damper lever of the present invention contains the relatively long fibers for reinforcement and can accordingly exhibit a very high rigidity, as compared with a jack made of a synthetic resin, with the result that the natural frequency can be more increased.

The damper lever is provided as part of a damper, and is pressed against a vibrating string in response to a released key to stop the vibration of the string, after the string has been struck for vibration to generate sound, thereby stopping the sound. From the fact that the damper lever exhibits a higher natural frequency as described above, the damper lever vibrates at a higher frequency than the conventional damper lever even when it vibrates together with the string against which the damper lever is pressed. Accordingly, the vibration can be stopped at an earlier time to promptly stop the sound, thus improving the sound stopping capabilities. Also, the vibration promptly stops, so that even when the same key is sequentially touched, the vibration of the string can be substantially stopped before the string is struck the next time, thus making it possible to normally vibrate the string, generate clear play sound, and consequently improve the sequential touching capabilities.

Since high sound stopping capabilities and sequential touching capabilities can be accomplished by increasing the natural frequency of the damper lever, the touch feeling of the key is never affected, unlike an increase in the spring force of the damper lever spring. Also, since the damper lever is made of a thermoplastic resin, it is possible to achieve the advantage of the synthetic resin, i.e., a high processing accuracy and dimensional stability.

Preferably, in the damper lever for a piano described above, the long fibers are carbon fibers.

Dust sticking to movable parts of the action can cause their slow motions which can degrade the responsibility of the damper. Also, in general, the carbon fiber is more electrically conductive than other long fibers for reinforcement, for example, glass fiber. Thus, by containing such carbon fibers in the thermoplastic resin, by which the damper lever is made, as long fibers for reinforcement, the damper lever can be improved in conductivity to reduce its electrostatic property. Consequently, since the reduced electrostatic property restrains dust from stacking to the damper lever, the damper can provide consistently good movements and responsibility. Also, the dust restrained from sticking to the damper lever can keep the appearance of the damper lever clear and prevent the operator's hands and clothing from being soiled in operations for adjusting the damper and the like.

Preferably, in the damper lever for a piano described above, the thermoplastic resin is an ABS resin.

The ABS resin has a high adhesivity among other thermoplastic resins. Therefore, when the damper lever is made of the ABS resin, another part can be readily adhered to the damper lever with an adhesive, thus facilitating the assembly of the damper.

Generally, when a thermoplastic resin containing a reinforcing material such as carbon fiber is injection molded at a high melt flow rate, the thermoplastic resin flows into a mold at higher speeds, causing a higher susceptibility to anisotropy in rigidity of the molding due to the reinforcing material tending to align in a particular direction in the molding. Also, the ABS resin is a thermoplastic resin containing a rubber-like polymer, and can be molded at a low melt flow rate. Accordingly, when the damper lever is made of the ABS resin as described above, the damper lever can be restrained in anisotropy and consistently provide a high rigidity. Further, the ductility exhibited by the ABS resin can enhance the impact strength of the damper lever.

DETAILED DESCRIPTION OF THE PREFERRED EMBODIMENT

Figure 1:
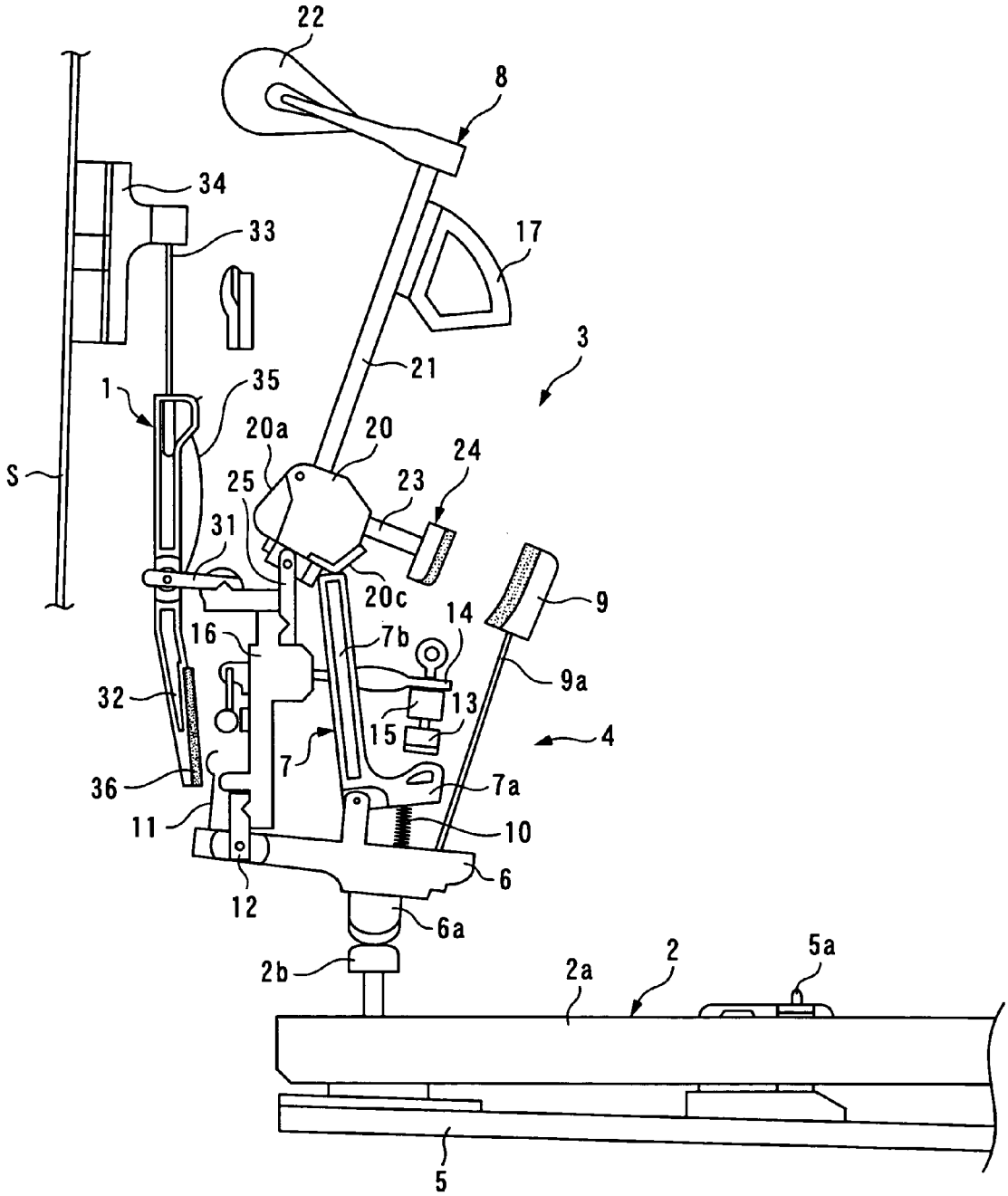
FIG. 1 is a side view illustrating an action, a hammer, and a damper lever, to which the present invention is applied, of an upright piano in a key released state.

In the following, a preferred embodiment of the present invention will be described in detail with reference to the accompanying drawings. FIG. 1 illustrates a damper 1 including a damper lever 32, to which the present invention is applied, a keyboard 2, an action 3 and the like of an upright piano in a key released state. In the following description, assume that, as viewed from a player side, the front side of the upright piano is called the "front," and the back side of the same, the "rear." The keyboard 2 comprises a large number of keys 2*a* (only one of which is shown) arranged side by side from left to right (in a depth direction in FIG. 1), and each key 2*a* is swingably supported by a fulcrum which is a balance pin 5*a* implanted on a keybed 5.

The action 3 is attached to a left and a right bracket (none of which is shown) arranged at a left and a right end of the keybed 5 above the rear end of the keyboard 2, and arranged to extend between both the brackets. The action 3 also comprises a wippen 6 and a jack 7 which are provided for each key 2*a* (only one each of them is shown). Further, a center rail 16 and a hammer rail 17 are extended between the left and right brackets, and a wippen flange 12 and a bat flange 25 (only one each of them is shown) are fixed to the center rail 16 with screws for each key 2*a*. The wippen 6 is pivotably supported by the wippen flange 12 at a rear end portion thereof. Also, a hammer 8 is pivotably supported by the bat flange 25.

The wippen 6, which is formed, for example, of a synthetic resin such as an ABS resin or a wood material in a predetermined shape, has a heel 6*a* extending downward from the front, and is carried on a capstan button 2*b* arranged on the top surface of a corresponding key 2*a* in a rear end area through the heel 6*a*. A back check wire 9*a* is implanted on the top surface of the wippen 6 in a front end area, and a back check 9 is attached to a leading end thereof. A spoon 11 is also implanted on the wippen 6 in a rear end area for driving the damper 1. Also, the aforementioned wippen flange 12 is disposed just in front of the spoon 11, and the wippen flange 12 is fixed to the center rail 16 above the spoon 11.

The jack 7, which is made, for example, of a synthetic resin or a wood material, is integrally molded in an L-shape, for example, by injection molding. The jack 7 comprises a base 7*a* extending in a front-to-back direction; and a hammer push-up rod 7*b* extending upward from the rear end of the base 7*a*. The jack 7 is pivotably supported at a central area of the wippen 6 through a pin-shaped jack fulcrum 10 at the corner between the base 7*a* and the hammer push-up rod 7*b* at a position behind the back check wire 9*a* of the wippen 6. A jack spring 10 is attached between the base 7*a* of the jack 7 and the wippen 6. The jack spring 10, which comprises a coil spring, is provided to urge the jack 7, as will be later described, and has a predetermined spring constant.

A regulating button 13 is arranged above the base 7*a* of the jack 7. The regulating button 13 is provided for each key 2*a* through a plurality of regulating brackets 14 (only one of which is shown) disposed on the center rail 16, and a regulating rail 15 which is attached to the front end the regulating bracket 14 and extends from left to right.

The hammer 8 (only one is shown) is also provided for each key 2*a*, and comprises a bat 20, a hammer shank 21, a hammer head 22, a catcher 24 and the like. The bat 20, which is formed, for example, of a synthetic resin or a wood material in a predetermined shape, is pivotably supported by the aforementioned bat flange 25. The bat flange 25 in turn is fixed to the center rail 16 at the lower end thereof.

The hammer shank 21, which is implanted on the top surface of the bat 20, extends downward, and the hammer head 3*c* is attached to the upper end of the hammer shank 21. The hammer head 22 opposes a string S stretched vertically at the back thereof, such that the hammer head 22 strikes the string S when an associated key is touched.

The bat 20 is also provided with a catcher shank 23. The catcher shank 23 extends in front diagonally downward from the front surface of the bat 20, and the catcher 24 is attached to the front end of the catcher shank 23 in opposition to the back check 9 located in front. A bat spring 20*a* is provided between the bat 20 and the hammer shank 21 for urging the hammer 8 in the clockwise direction in FIG. 1. In a key released state, the hammer 8 remains stationary with the hammer push-up rod 7*b* of the jack 7 in engagement with a pushed corner 20*c*, formed by a front end area of the bottom surface of the bat 20, from below.

Figures 2, 3:
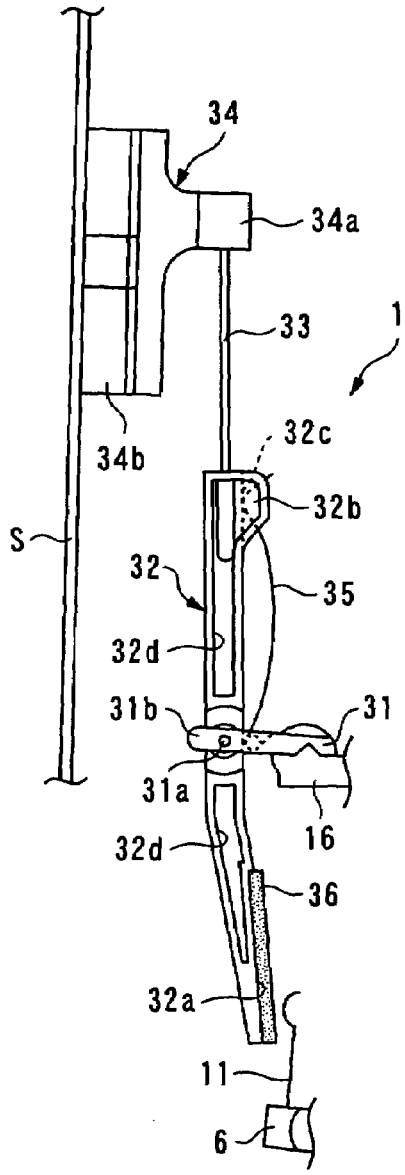
FIG. 2 is a side view illustrating the damper in FIG. 1.
FIG. 3 is a table showing the weight and rigidity of the damper lever according the present invention and damper levers of a first and a second comparative example, respectively, as a ratio to the first comparative example.

A damper 1 (only one of which is shown) is provided for each key 2*a* behind the action 3. As illustrated in FIG. 2, the damper 1 comprises a damper lever 32 pivotably attached to a damper flange 31 screwed to the center rail 16 through a pin-shaped fulcrum 31*a*, a damper wire 33 and a damper head 34 attached to the damper lever 32, a damper lever spring 35 for urging the damper lever 32 toward the string S, and the like. The damper 1 is provided to stop sound by the damper head 34 which is brought into contact with the string S by an urging force of the damper lever spring 35 when the key 2*a* is released.

The damper lever flange 31 is molded in a block shape, and has a pair of lever supports 31*b* (only one of which is shown) extending from a left and a right end thereof, respectively, toward the back. The damper lever 32 is inserted between both the lever supports 31*b* and supported by the fulcrum 31*a*.

The damper lever 32, which is formed by a continuous fiber method, is injection molded using a pellet as described below. This pellet is manufactured by covering lobings made of carbon fiber with a thermoplastic resin containing a rubber-like polymer, for example, an ABS resin, which is one type of synthetic resin, extruded by an extruder, while the lobings are made even with a predetermined tension applied thereto. In this way, the lobings of carbon fiber can be contained in the pellet when it is molded without bending the lobings, so that the pellet contains carbon fibers which are equal in length to the pellet. In this embodiment, the length of the pellet is set in a range of 5 to 15 mm, whereby carbon fibers of 0.5 to 2 mm long are contained in the damper lever 32 which is injection molded using the pellet. A melt flow rate is set to a relatively small value for the aforementioned rubber-like polymer, for example, in a range of 0.1 to 50 g per 10 minutes under a testing condition including the temperature of 230° C. and a load of 2.12 kg.

The damper lever 32 is formed in a rod shape as a whole by the continuous fiber method as mentioned above, and supported by the fulcrum 31*a* at the center thereof, and extends in the vertical direction. The damper lever 32 is formed with a stepped surface 32*a* recessed in the lower end of the front surface thereof, and a felt 36 is adhered to the stepped surface 32*a* with an adhesive. Also, a spring support 32*b* is formed on the front surface of the damper lever 32 to extend in front from the upper end thereof, and a spring supporting groove 32*c* is formed in the front surface thereof to extend in the vertical direction. An upper and a lower recess 32*d* are formed on a left and a right side surface of the damper lever 32, respectively, for reducing the weight (the left side surface alone is shown).

The damper lever spring 35 is provided between the damper lever flange 31 and the spring supporting groove 32*c* of the damper lever 32. The damper lever spring 35 is attached to the damper lever flange 31 at the lower end, and urges against the damper lever 32 at the upper end through the spring supporting groove 32*c* of the spring support 32*b* to urge the damper lever 32 in the counter-clockwise direction.

The damper wire 33 is implanted on the top surface of the damper lever 32, and the damper head 34 is attached to an upper end of the damper wire 33. The damper head 34 comprises a damper block 34*a* attached to the upper end of the damper wire 33, and a damper felt 34*b* adhered to a back surface of the damper block 34*a*. The damper head 34 is in contact with the string S located behind and is pressed against the same by an urging force of the damper lever spring 35.

Next, a description will be given of a sequence of operations performed by the damper 1, action 3, hammer 8 and the like from the start to the end of a key depression. As a player touches the key 2*a* from the released state as illustrated in FIG. 1, the key 2*a* pivotally moves in the clockwise direction in FIG. 1 about the balance pin 5*a* to push up the wippen 6 carried in the rear end area thereof, thereby causing the same to pivotally move upward (counter-clockwise direction). Associated with the pivotal movement of the wippen 6, the jack 7, back check 9, and spoon 11 move together, and the hammer 8 has its bat 20 pushed up by the hammer push-up rod 7*b* of the jack 7 to swing toward the string S, positioned behind, in the counter-clockwise direction.

When the wippen 6 has pivotally moved over a predetermined angular distance after the key touch was started, the spoon 11 disposed in a rear end area of the wippen 6 comes into contact with the lower end of the damper lever 32 through the felt 36, and is pressed against the damper lever 32. As the key touch is advanced, the spoon 11 pivotally moves the damper lever 32 against the urging force of the damper lever spring 35 about the fulcrum 31*a* in the clockwise direction. This causes the damper head 34 to move away from the string S, thus allowing the string S to vibrate.

As the wippen 6 has further pivotally moved over a predetermined angular distance, the front end of the base 7*a* of the jack 7 comes into contact with the regulating button 13 from below. Consequently, the jack 7 is restricted from moving upward, and pivotally moves in the clockwise direction with respect to the wippen 6 against the urging force of the jack spring 10, causing the hammer push-up rod 7*b* to let off the bat 20 in front and come off the hammer 8. Even after the jack 7 has come off, the hammer 8 continues to swing with inertia to strike the string S for vibrations, thereby generating sound. Then, the hammer 8 starts a pivotal movement in the clockwise direction by a repellent force of the string S to return to the home position.

After the key touch has been completed with the key 2*a* being released, the key 2*a*, action 3 and the like pivotally move in the direction reverse to that when the key was touched, and associated with this, the spool 11 also moves together with the wippen 6 in the direction reverse to that when the key was touched, i.e., in the clockwise direction, and moves away from the damper lever 32. Consequently, the damper 1 also pivotally moves in the direction reverse to that when the key was touched by the urging force of the damper lever spring 35, causing the damper head 34 to come into contact with the string S from the front to resume to press against the string S.

When the damper head 34 comes into contact with the string S, the string S is still vibrating, so that the string S and damper 1 vibrate together immediately after the start of a sound stopping operation performed by the damper head 34. Then, the vibration rapidly attenuates to rapidly reduce the volume of sound. As the vibration eventually stops, the generated sound is muted, thus terminating the sound stopping operation. Subsequently, the respective components return to the key released state illustrated in FIG. 1, followed by termination of the sequence of operations involved in the key touch and key release.

As described above, according to this embodiment, since the damper lever 32 comprises a molding made of thermoplastic resin containing long fibers for reinforcement, molded by the continuous fiber method, the damper lever 32 exhibits a very high rigidity and as a result, a high natural frequency. Accordingly, when the damper 1 including the damper lever 32 as described above vibrates together with the string S, while the damper 1 is pressed against the string S, its frequency can also be increased over that of the conventional damper lever. As a result, since the vibration more rapidly stops, sound can be promptly muted, thus improving the sound stopping capabilities.

Also, the vibration promptly stops, so that even when the same key 2*a* is sequentially touched, the vibration of the string S can be substantially stopped before the string S is struck the next time, thus making it possible to normally vibrate the string S, generate clear play sound, and consequently improve the sequential touching capabilities. Since high sound stopping capabilities and sequential touching capabilities can be accomplished by increasing the natural frequency of the damper 32, the touch feeling of the key 2*a* is never affected, unlike an increase in the spring force of the damper lever spring 35. Also, since the damper lever 32 is made of a thermoplastic resin, it is possible to achieve the advantage of the synthetic resin, i.e., high processing accuracy and dimensional stability.

Also, since the damper lever 32 is made of a thermoplastic resin which contains long carbon fibers for reinforcement, the damper lever 32 can be improved in conductivity to reduce the electrostatic property. Since the reduced electrostatic property restrains dust which could stick to the damper lever 32, the damper 1 can provide consistently good movements and responsibility. Also, the dust restrained from sticking to the damper lever 32 can keep the appearance of the damper lever 32 clear and prevent the operator's hands and clothing from being soiled in operations for adjusting the damper 1 and the like.

The ABS resin has a high adhesivity among other thermoplastic resins, so that when the damper lever 32 is made of the ABS resin, the felt 36 or the like can be readily adhered to the damper lever 32 with an adhesive, thus facilitating the assembly of the damper 1.

Also, the ABS resin is a thermoplastic resin containing a rubber-like polymer and can be molded at a low melt flow rate. Accordingly, when the damper lever 32 is made of the ABS resin, the damper lever 32 can be restrained in anisotropy and consistently provide a high rigidity. Further, the ductility exhibited by the ABS resin can enhance the impact strength of the damper lever 32.

FIG. 3 shows the result of a rigidity test which was made to confirm the weight and reinforcing effect of the damper lever 32 according to the foregoing embodiment, together with a first and a second comparative example. The first comparative example is a damper lever which comprises a conventional molding made of a synthetic resin, while the second comparative example is a damper lever made of a wood material. The first and second comparative examples have the same size and shape as the damper lever 32. The rigidity test involved applying a load to one end of each damper lever supported at the other end from above, measuring a displacement, and calculating the rigidity from a calculation between the load and the displacement. As shown in FIG. 3, the weight ratio of these damper lever is 1.04 for the damper lever 32 according to the embodiment, and 0.89 for the second comparative example, when the weight of the damper lever of the first comparative example is 1.0. As can be seen, the damper lever 32 according to the embodiment is slightly heavier than the damper lever made of a wood material, and has substantially the same weight as the damper lever made of the synthetic resin. The rigidity ratio, in turn, is 2.02 for the damper lever 32 according to the embodiment, and 2.33 for the damper lever of the second comparative example, when the damper lever of the first comparative example is assumed to exhibit the rigidity of 1.0. It is confirmed that the damper lever 32 according to the embodiment exhibits a rigidity substantially twice as high as the damper lever made of the synthetic resin, and the rigidity can be increased to the same level as the damper lever made of the wood material.

Figure 4:
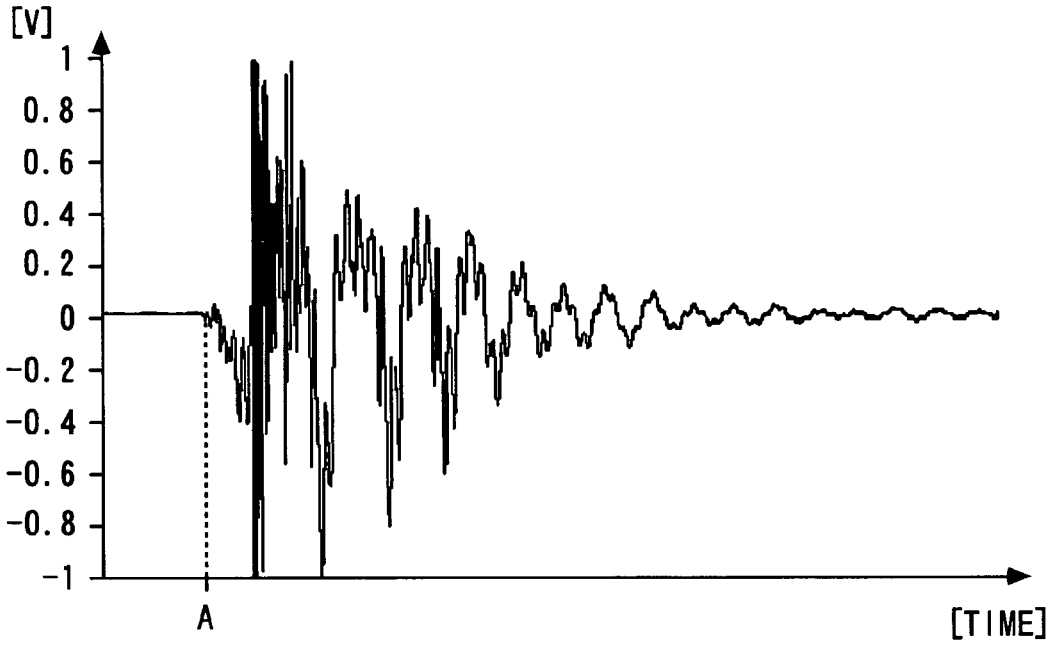
FIG. 4 is a graph showing a vibration attenuation waveform when sound from a string is stopped by the damper lever according to the present invention.
Figure 5:
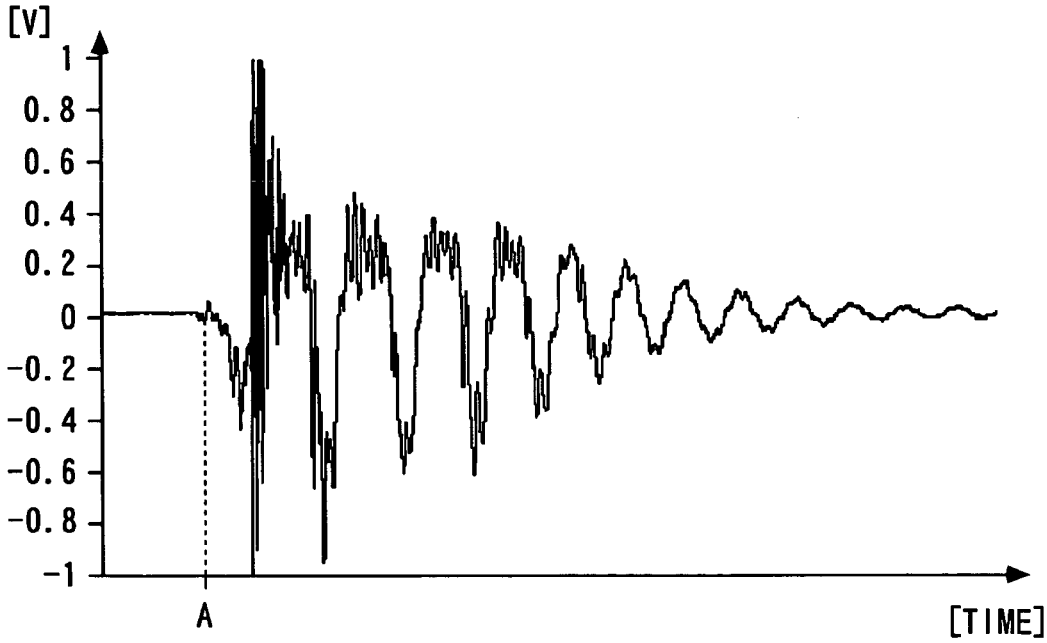
FIG. 5 is a graph showing a vibration attenuation waveform when sound from a string is stopped by the damper lever of the first comparative example.
Figures 6, 7:
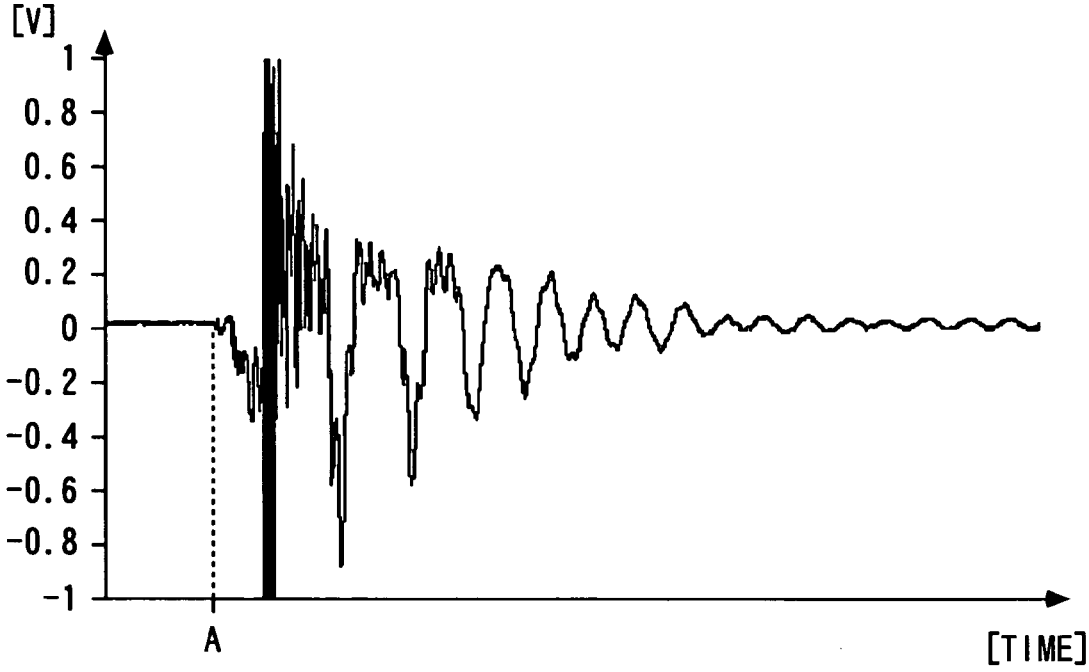
FIG. 6 is a graph showing a vibration attenuation waveform when sound from a string is stopped by the damper lever of the second comparative example.
FIG. 7 is a table showing a string vibration attenuation time when sound is stopped using the damper lever according to the present invention, and the damper levers of the first and second comparative examples, respectively, as a ratio to the first comparative example.

FIGS. 4 to 6 are graphs showing the result of a test which was made to confirm the sound stopping capabilities of dampers which employed damper levers of the embodiment, and the first and second comparative examples, respectively. The test was conducted in the following manner. First, an acceleration pickup was attached to the damper head 34, and a key was touched with a finger at intensities of mezzo forte to forte, and a waveform of an output value (voltage value) from the acceleration pickup was recorded from the start of a key touch. Also, from this record, the amplitude of the waveform converged to 0.02 volts or lower was defined to be sound stop, and an attenuation time was measured from the start of the key touch to the sound stop.

FIGS. 4 to 6 show representative waveforms of the embodiment and the first and second comparative examples resulting from the foregoing test. As shown in FIG. 5, when the damper lever of the first comparative example is used, the amplitude suddenly increases when the damper comes into contact with the string S (at a point A in FIG. 5), and subsequently attenuates over time, but a long time is taken to attenuate the vibration because of a low frequency during the attenuation. In contrast, when the damper lever 32 according to the embodiment was used, the amplitude was reduced in a shorter time than the first embodiment, as shown in FIG. 4, because of a higher frequency during the attenuation of the vibration. Also, as shown in FIG. 6, when the damper lever of the second comparative example was used, substantially the same waveform was generated as that generated using the damper lever 32 according to the embodiment. In this test, five samples were provided for each of the damper levers of the embodiment and the first and second comparative examples, and the foregoing test was conducted for each sample, a total of ten times. Then, an average of attenuation times measured in 50 tests (5 (number of samples)×10 (number of times of tests) =50) was calculated to derive the attenuation time.

FIG. 7 shows the attenuation times, in ratio, of the embodiment and the first and second comparative examples calculated as described above. According to FIG. 7, when the attenuation time calculated for the damper lever of the first comparative example was assumed to be 1.0, the attenuation time was reduced to 0.84 with the damper lever 32 of the embodiment, and to 0.91 with the damper lever of the second comparative example. It was confirmed from the foregoing result that the vibration was quite promptly attenuated when the damper lever 32 of the embodiment was used than when the damper lever made of synthetic resin was used and when the damper lever made of wood material was used, to significantly improve the sound stopping capabilities.

It should be understood that the present invention is not limited to the embodiments described above, but can be practiced in a variety of implementations. Otherwise, details in configuration can be modified as appropriate within the scope of the present invention.

What is claimed is:

1. A damper lever for an upright piano, adapted to be pressed against a vibrating string to stop the vibration in response to a released key, in order to stop sound which has been generated from the vibrating string, wherein:

said damper lever comprises a molding molded by a continuous fiber method and made of a thermoplastic resin containing long fibers for reinforcement such that the damper lever has a higher natural frequency, and thus, vibrates at a higher frequency.

2. A damper lever for a piano according to claim 1, wherein said long fibers are carbon fibers.

3. A damper lever for a piano according to claim 1 or 2, wherein said thermoplastic resin is an ABS resin.

4. A damper lever for a piano according to claim 1, wherein the higher natural frequency is higher than a natural frequency of a damper lever made of a synthetic resin.

5. A damper lever for a piano according to claim 1, wherein the damper lever has a rigidity substantially twice as high as a rigidity of a damper lever made of a synthetic resin.

6. A damper lever for a piano according to claim 1, wherein the damper lever has a rigidity substantially equal to a rigidity of a damper lever made of a wood.

7. A damper lever for a piano according to claim 1, wherein the damper lever has an attenuation time of substantially 84% of an attenuation time of a damper lever made of a synthetic resin.

8. A damper lever for a piano according to claim 1, wherein the damper lever has an attenuation time that is less than an attenuation time of a damper lever made of a wood.

9. A damper lever for a piano according to claim 2, wherein the damper lever is an injection molded pellet, wherein the pellet includes lobings made of the carbon fibers and wherein the thermoplastic resin covers the lobings.

10. A damper lever for a piano according to claim 9, wherein the lobings have a predetermined tension applied to the lobings.

11. A damper lever for a piano according to claim 9, wherein the carbon fibers have a length which is equal to a length of the pellet.

* * * * *